US005310338A

United States Patent [19]

Harding

[11] Patent Number: 5,310,338

[45] Date of Patent: May 10, 1994

[54] HEAT RETAINING CURTAINS FOR REHEAT FURNACE DISCHARGE OPENINGS AND CHARGING OPENINGS

[75] Inventor: Hugh J. Harding, McMurray, Pa.

[73] Assignee: SSE International Corporation, Bridgeville, Pa.

[21] Appl. No.: 36,279

[22] Filed: Mar. 24, 1993

[51] Int. Cl.[5] ..... F24F 9/00

[52] U.S. Cl. ..... 432/64; 432/242; 432/250

[58] Field of Search ..... 432/242, 250, 244, 64, 432/115

[56] References Cited

U.S. PATENT DOCUMENTS 3,841,614 10/1974 Okuno ..... 432/64
4,411,075 10/1983 Blaudszun ..... 432/242
4,517,448 5/1985 Crain et al. ..... 432/64
4,681,536 7/1987 Jansen ..... 432/242
5,172,849 12/1992 Barten et al. ..... 432/242

*Primary Examiner*—Henry C. Yuen
*Attorney, Agent, or Firm*—Harry B. Keck

[57] ABSTRACT

A discharge opening for a reheat furnace is shielded with a pair of metal woven wire mesh curtains each secured above the discharge opening and hanging to the bottom of the opening. Each curtain preferably is formed from multiple parallel coplanar ribbons, each extending from above the discharge opening to the bottom of the discharge opening. The mesh curtains are fabricated from a sag resistant metal alloy. Embodiments are described for accommodating slots which receive discharge lifter members for removing heated metal workpieces from the furnace. A preferred mounting apparatus employs one or more fibrous thermal insulation strips above the discharge opening. A counterweight mounting apparatus urges the fibrous thermal insulating strips against the outer wall of the furnace.

14 Claims, 9 Drawing Sheets

Fig. 17
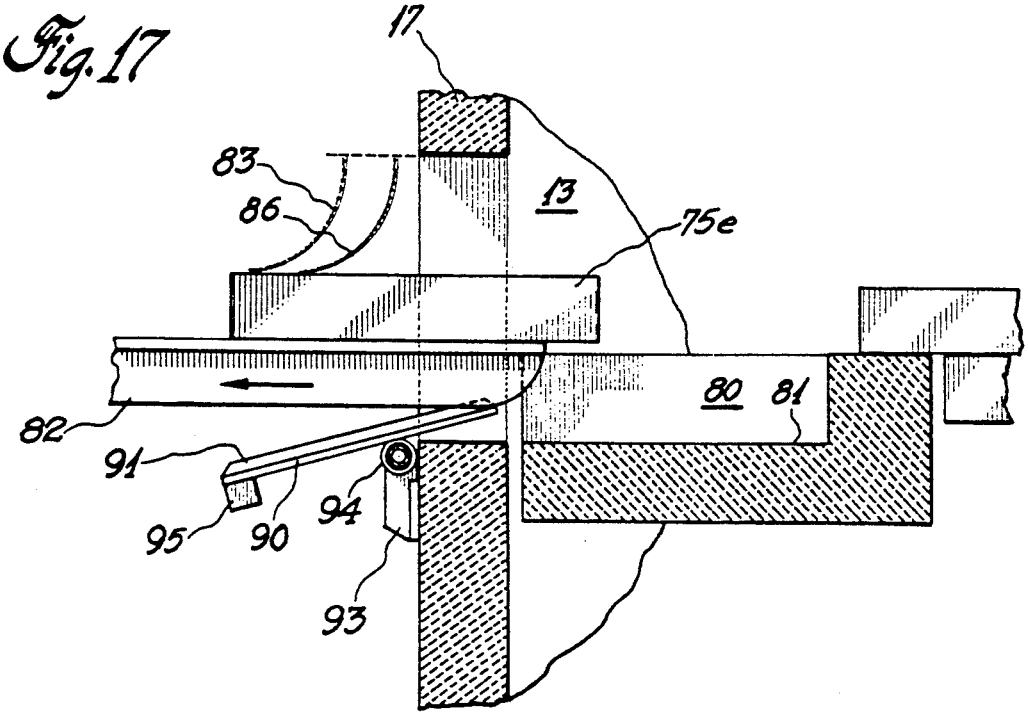
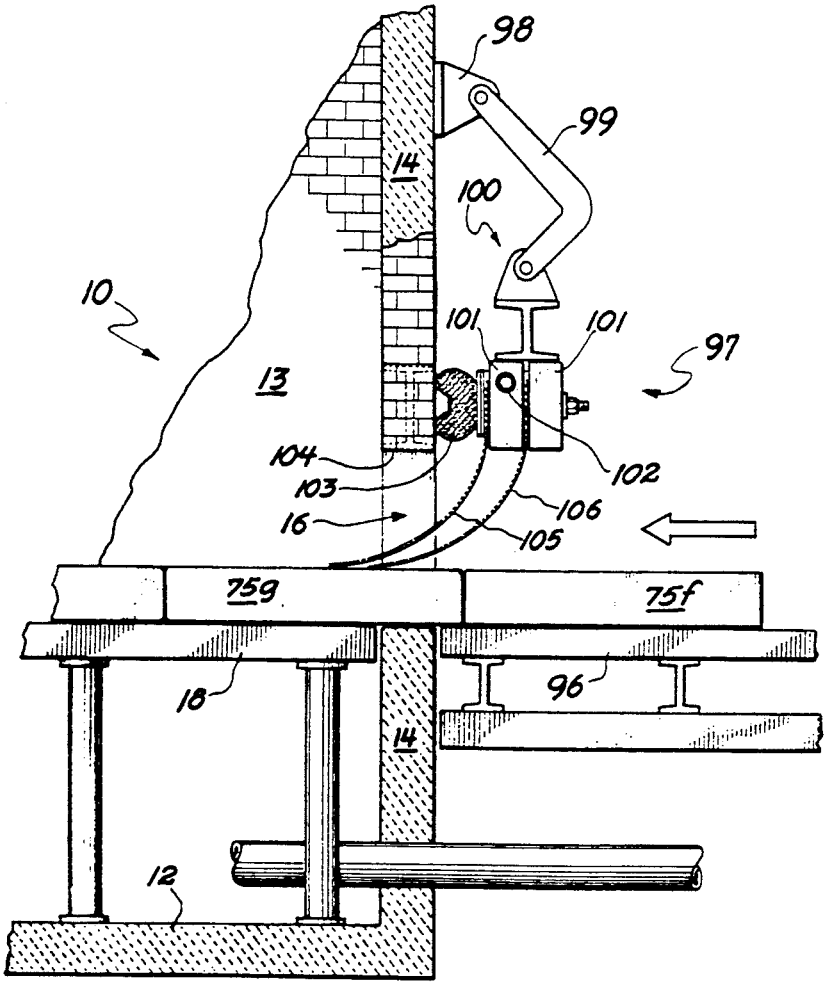
Fig. 18

HEAT RETAINING CURTAINS FOR REHEAT FURNACE DISCHARGE OPENINGS AND CHARGING OPENINGS

BACKGROUND OF THE INVENTION

1. Field of the Invention

The present invention relates to a closure for the discharge opening of a steel reheat furnace comprising sag-resistant metal alloy mesh curtains formed from plural steel mesh ribbons. The metal alloy mesh curtains also may be employed in the charging opening of certain reheat furnaces. The purpose of the metal alloy mesh curtains is to retain heat energy within the reheat furnace by reducing the opportunities for heat to leave the furnace.

2. Description of the Prior Art

Steel reheat furnaces are employed to reheat steel workpieces to a temperature at which the steel may be mechanically worked outside the reheat furnace. U.S. Pat. Nos. 3,148,868; 3,716,222; 3,749,550; 4,427,371. The steel workpieces are heated to temperatures of 2000° F. and higher. The reheat furnaces have refractory ceilings, side walls and floors and include plural heat sources such as gas burners or radiant gas burners. Horizontal rails are mounted within the furnace to support steel workpieces as they move through the furnace from a charging opening at one end to a discharge opening at the other end. The temperature gradient across most reheat furnaces develops the highest temperatures adjacent to the discharge opening and usually significantly lower temperatures adjacent to the charging opening. A refractory slab customarily is positioned within the furnace adjacent to the discharge opening. Multiple slots are presented within the refractory slab to receive fingers for directing and withdrawing the forward-most workpiece from the refractory slab through the discharge opening.

With the advent of high temperature radiant heaters, it is now possible to develop high temperatures within a reheat furnace adjacent to the charging openings. Reheat furnaces provided with high temperatures adjacent to the charging openings will benefit from the curtains of this invention. Such installation will be separately discussed in this specification which is principally concerned with discharge openings.

Heated steel workpieces are removed from the reheat furnace through the discharge opening, and new workpieces are introduced through the charging opening whereby a continuous inventory of steel workpieces at gradually increasing temperatures is maintained inside the reheat furnace. Customarily the discharge opening is in line with the movement of steel workpieces through the furnace; however the discharge opening may be angled with respect to the line of movement, e.g., U.S. Pat. No. 4,492,565.

Customarily one or more vertical steel or composite assemblies are provided to function as doors at the charging opening and at the discharge opening. U.S. Pat. No. 4,669,939. The doors are raised vertically by cables to expose the charging opening or discharge opening and the doors are maintained in an elevated position until a steel workpiece or workpieces enters the charging opening or is withdrawn through the discharge opening. Immediately thereafter the doors are lowered to obstruct heat loss through the openings. A significant heat loss occurs during the time when the doors are elevated and the openings are exposed. The heat loss is usually greatest at the discharge opening where the temperatures the highest in the structure.

It is known to employ steel mesh curtains at the charging opening of a reheat furnace which heretofore experienced elevated temperatures of the order of 1500° F. At these temperatures, woven mesh curtains of ordinary steel are not adversely affected by the temperature exposure. However steel mesh curtains have not been employed at the discharge opening of reheat furnaces where the furnace heat loss can be severe.

Some reheat furnaces may experience much higher temperatures as a result of recently available radiant heat sources which can be located adjacent to the charging opening of reheat furnaces. In such reheat furnaces, the curtains of this invention will provide reliable heat retention.

STATEMENT OF THE PRESENT INVENTION

According to this invention metal alloy wire mesh curtains can be fabricated from plural ribbons of high temperature, sag-resistant metal alloy wire, formed from chromium/iron/aluminum alloys, e.g., Kanthal APM, the Tradename of a chromium/iron/aluminum alloy of Kanthal, AB. Such curtains may be employed at the discharge openings of reheat furnaces and at the charging openings of certain reheat furnaces. A discharge opening normally includes a water-cooled lintel defining the horizontal top of the discharge opening.

The curtains are fabricated from multiple, substantially co-planar vertical ribbons of metal alloy wire mesh, each secured at its top adjacent to the water-cooled lintel. Each ribbon is freely suspended, terminating at or adjacent to the bottom level of the furnace discharge opening. The ribbons are secured to a horizontal steel conduit through which cooling water is delivered. In a preferred embodiment, two distinct curtains are mounted in horizontally-spaced-apart relation so that the exiting workpieces engage a first curtain and thereafter engage a second curtain while moving through a reheat furnace discharge opening. Preferably the interior metal alloy mesh curtain confronting the heat source is fabricated from thin wire and has relatively small mesh openings. The exterior metal alloy curtain is fabricated from thicker coarse wire and has larger mesh openings. Thus the interior metal alloy curtain is less permeable to gas flow and more resistant to heat transmission than the exterior metal alloy mesh curtain.

The advancing workpieces displace the metal alloy mesh curtains in the direction of movement of the workpiece with the result that the bottom portions of the metal alloy mesh ribbons are draped or dragged across the upper surface of the exiting steel workpieces, providing limited openings for facile heat loss through the furnace openings.

In furnaces having slots adjacent to and beneath the discharge openings, means are provided for separately sealing the slot openings to retard heat loss through the slot openings. A preferred slot opening means is a ribbon of the mesh material corresponding in width to the slot width, extending from above the discharge opening to the bottom of a slot. Alternatively a wide curtain may be provided with one or more depending curtain sections which correspond dimensionally to a slot opening.

Means are provided to raise a slot opening curtain above the top of the slot prior to entry of a lifter into a slot to preclude engagement of the lifter with a slot opening curtain during entry of a lifter into a slot.

An alternative slot cover is a counter-weighted, heat resistant sheet which is pivoted about a horizontal axis outboard and beneath a slot exterior opening. This sheet permits use of discharge opening curtains having a straight, horizontal bottom edge. The heat resistant sheet pivots in advance of a lifter, rests beneath a lifter during workpiece extraction, and is restored to a slot-opening cover position as the lifter is withdrawn from the slot. Preferably the pivot means includes water-cooling capacity.

Accordingly a principal object of this invention is to provide metal alloy wire mesh ribbons to form one or more vertical curtains which normally substantially entirely cover the discharge opening of a high temperature reheat furnace and resist heat loss through the opening.

Another object of this invention is to provide high temperature, sag-resistant metal alloy wire mesh ribbons forming a curtain for discharge openings of a high temperature reheat furnace, together with a water-cooled beam from which the steel wire mesh ribbons are suspended.

A still further object of this invention is to provide novel structure for securing metal alloy wire mesh curtains in heat retaining relation with a discharge opening of a high temperature reheat furnace.

Another object of this invention is to provide means to cover slot openings in those furnaces which employ slots and correlated lifters to extract heated workpieces through a discharge opening.

A still further object of this invention is to provide a heat resistant curtain structure outboard of the charging opening of those reheat furnaces which have high temperatures developed adjacent to the charging opening.

DESCRIPTION OF THE DRAWINGS

FIG. 4 is a sectional view taken along the line 4—4 of FIG. 5.

FIGS. 14, 16 and 17 are fragmentary cross-section illustrations of a discharge opening with slots and an alternative embodiment of a slot closure member.

FIG. 18 is a fragmentary cross-section illustration of the charging opening of a reheat oven.

FIG. 1 illustrates a typical reheat furnace 10 having a refractory top wall 11 and floor 12, refractory side walls 13 and refractory end walls 14, 15. The refractory end wall 14 has a charging opening 16. The refractory end wall 15 has a discharge opening 17. Extended through the furnace is a horizontal beam assembly 18 which supports steel workpieces as they move through the furnace from the charging opening 16 to the discharge opening 17. Multiple heat sources such as gas burners 19 are mounted at selected locations on the top walls of the furnace. Additional gas burners 19' are provided beneath the horizontal beam assembly 18. A flue 20 receives the gaseous products of combustion which are generated within the furnace 10. Thermal energy in the combustion gases is usually recovered in heat regenerators. A removable closure member 21 is provided to obstruct the charging opening 16 to permit introduction of steel workpieces which are to be heated in the furnace. A removable closure member 22 is provided to obstruct the discharge opening 17 except when heated workpieces are removed through the discharge opening 17. The temperature within the reheat furnace 10 increases from the charging opening 16, where steel workpieces at ambient temperature are introduced into the furnace, to a maximum temperature at the discharge opening 17 where steel workpieces, heated to an appropriate working temperature are withdrawn from the furnace 10. A refractory hearth 80 is usually provided adjacent to the discharge opening 17 to support the steel workpieces prior to withdrawal from the furnace 10. Slots 81 are presented in the refractory hearth 80 to accommodate extending fingers 82, called "lifters", (FIGS. 5, 9, 10) of a typical workpiece withdrawal device which elevates a finished workpiece above the refractory hearth 80 and removes the finished workpiece through the discharge opening 17. Because the temperature of the reheat furnace 10 adjacent to the discharge opening 17 is a maximum temperature, substantially more heat energy is lost from the furnace through the discharge opening 17 than through the charging opening 16. Temperatures as high as 2500° F. are common in reheat furnaces adjacent to the discharge opening 17. The removable closure members 21, 22 are frequently formed from rectangular slabs of refractory materials in appropriate metal frames. Supporting means (not shown) are required to lift the closure members 21, 22 up and away from the furnace opening 16, 17, respectively.

According to the present invention, two horizontally spaced-apart curtains are presented at the discharge opening 17 to serve as a closure for the opening 17 to retard loss of heat energy through the discharge opening 17. The spaced-apart curtains are formed from aligned metal alloy woven mesh ribbons which are secured at their top in a common vertical plane and can move and drape over a steel workpiece moving outwardly from the furnace through the discharge opening 17.

Figure 2:
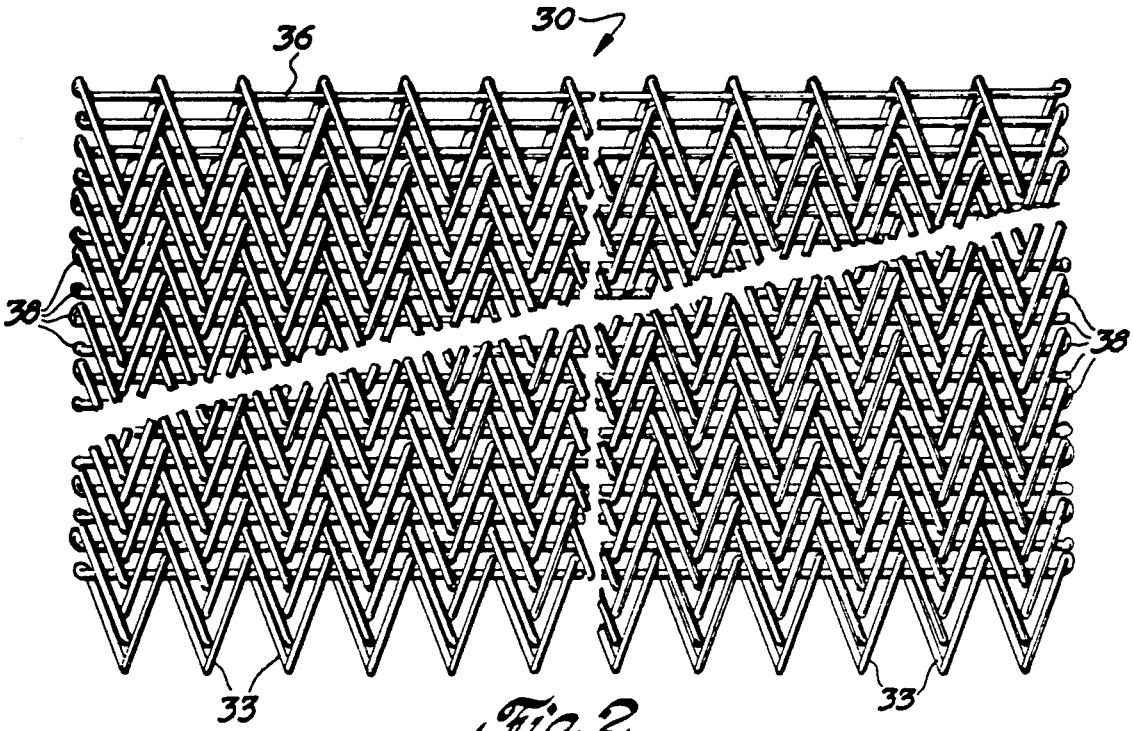
FIGS. 2 and 3 are illustrations of metal alloy wire mesh ribbon.
Figure 3:
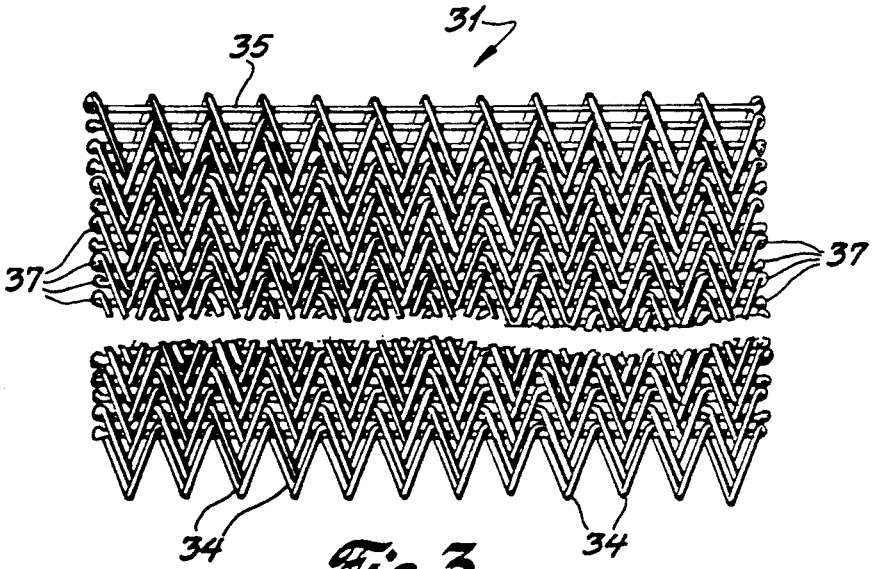

Woven metal alloy mesh ribbons are illustrated in FIGS. 2 and 3. The ribbons 30, 31 include helical wire warp elements 33, 34 and straight wire woof elements 35, 36. The warp elements 33, 34 are nested to establish aligned passageways through which the woof elements 35 may be positioned. The exposed ends 37, 38 of the straight wire woof elements 35, 36 respectively, are deformed to establish suitable heads which prevent withdrawal of the woof elements in either direction from the aligned passageways established by the nested, modified helical warp elements 33, 34. Such woven mesh is readily available in ordinary carbon steel and other specialty metal alloys. Steel mesh ribbon similar to the ribbons 30, 31 have been employed in steel reheat furnaces to provide double steel mesh curtains at the charging opening of the furnaces where conventionally the existing temperatures will not adversely affect the curtains.

The metal alloy woven mesh ribbons of the present invention are fabricated from sag resistant metal alloy, typically an alloy of aluminum/chromium/iron and more particularly from a specific aluminum/chromium-/iron alloy known as Kanthal APM. The APM alloy has significant sag resistance at temperatures of 2500° F. and higher.

The warp elements 33 of FIG. 2 are larger than the warp elements 34 of FIG. 3. Similarly the woof elements 36 of FIG. 2 are larger than the woof elements 35 of FIG. 3. As a result the metal alloy woven mesh ribbon 30 (FIG. 2) is more porous, i.e., has larger openings, than the steel woven mesh ribbon 31 of FIG. 3.

TYPICAL INSTALLATION

Figure 4:
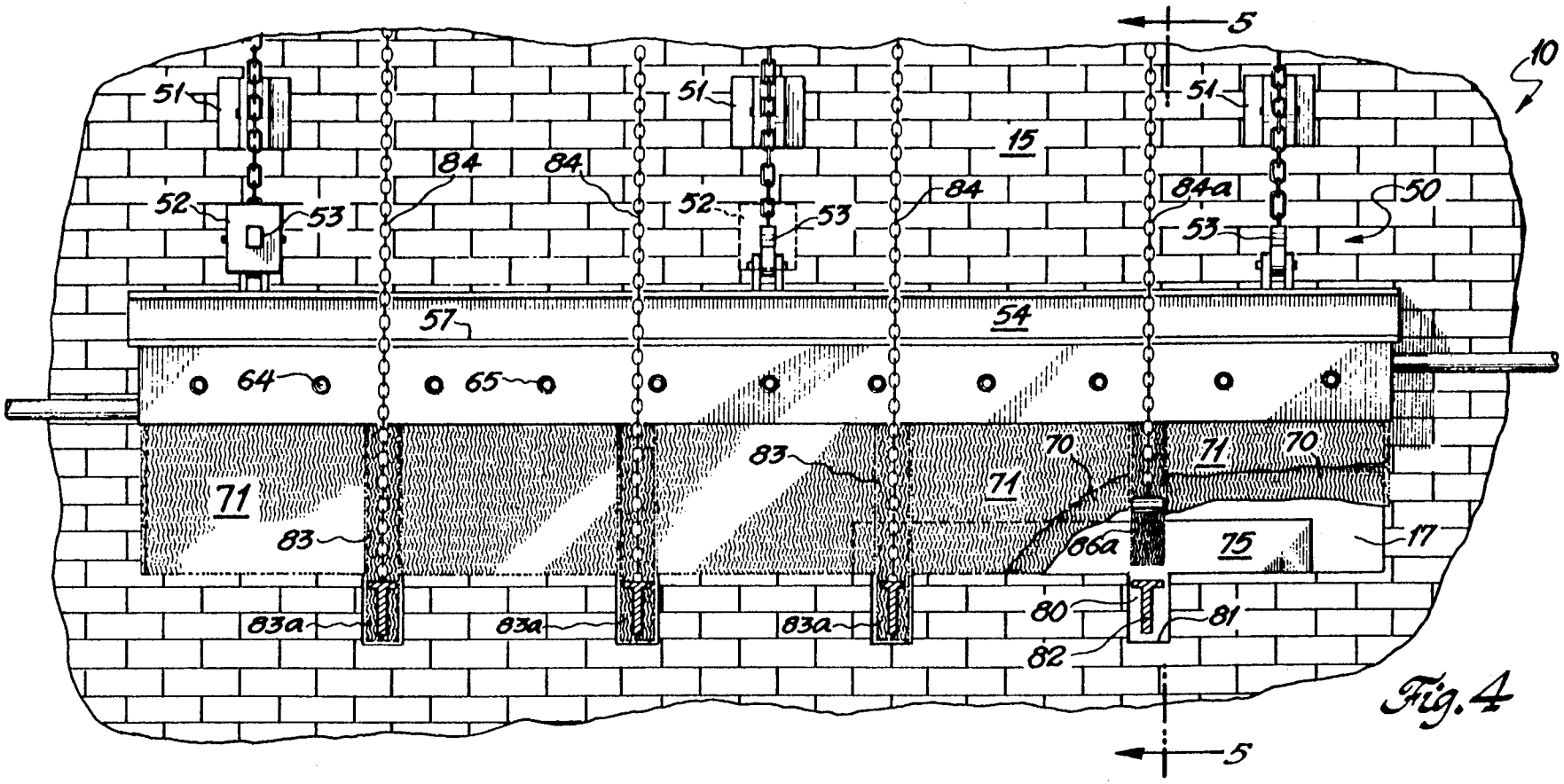
FIG. 4 is a fragmentary end view of a reheat furnace discharge opening illustrating a metal alloy wire mesh curtain, formed from metal alloy wire mesh ribbons in accordance with this invention.
Figure 5:
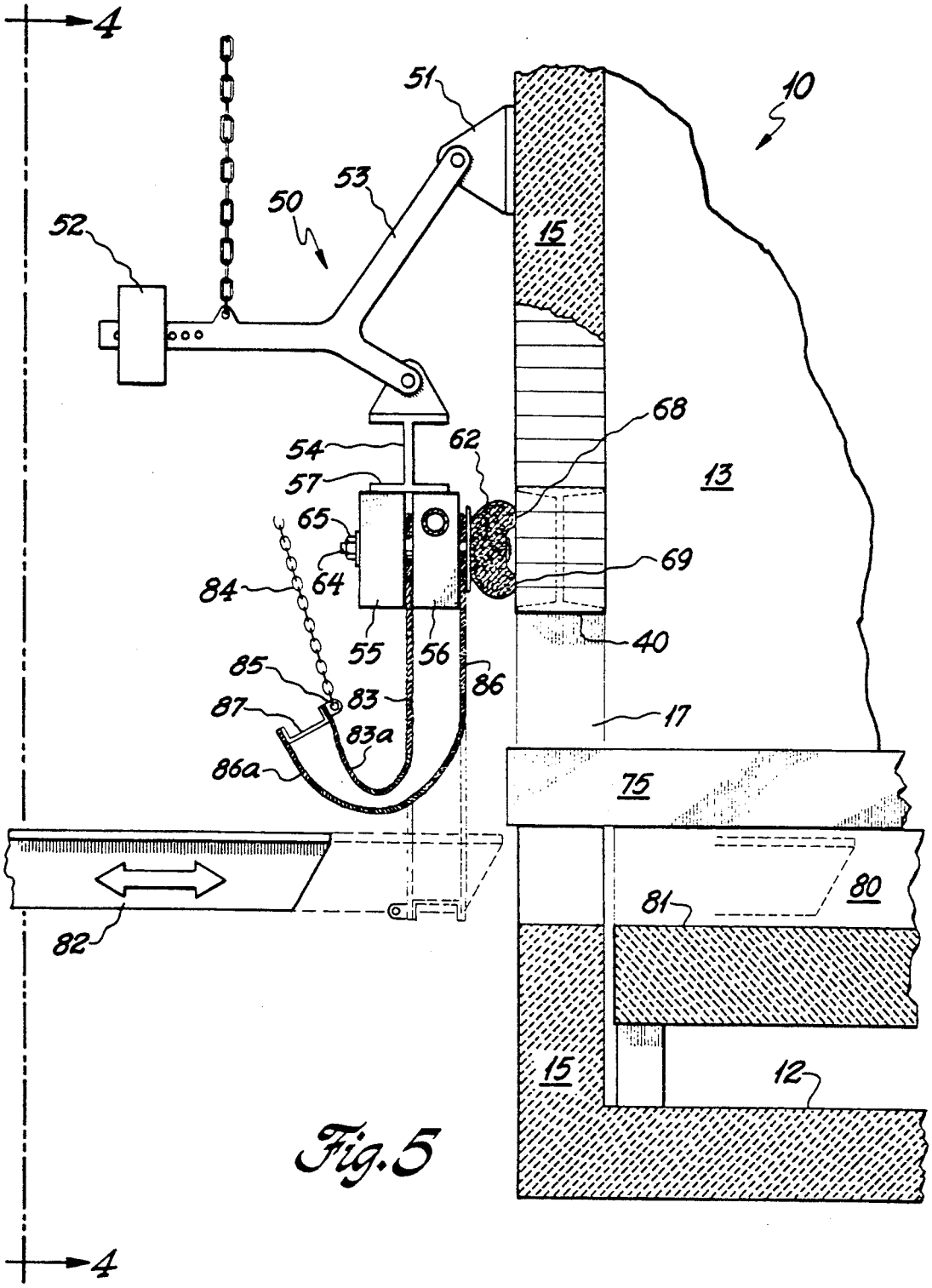
FIG. 5 is a fragmentary side elevation view taken along the line 5—5 of FIG. 4, illustrating a curtain installation according to this invention. NOTE.
Figure 8:
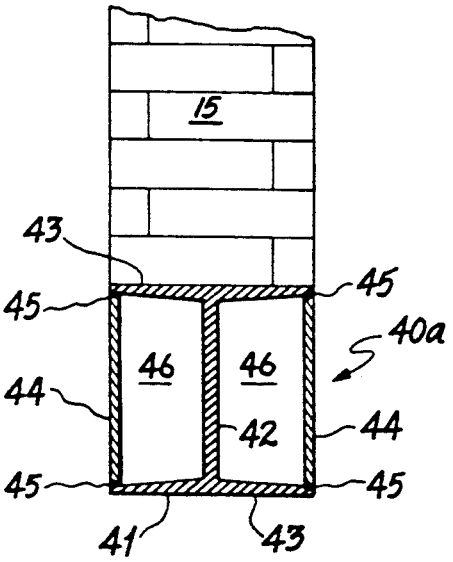
FIG. 8 is a cross-section illustration of a typical water-cooled lintel.

Referring to FIGS. 4 and 5, the discharge end of a reheat furnace 10 has a refractory end wall 15 with a generally rectangular discharge opening 17. A water-cooled lintel 40 (FIG. 5) customarily is provided along the top of the opening 17 to provide structural support for the end wall 15. A typical water-cooled lintel construction is illustrated in FIG. 8 wherein a lintel 40*a* is formed from a horizontal beam 41 having a web 42 and flanges 43. Steel sheets 44 are welded to the flanges 43 by means of continuous welds 45 to define water passageways 46 through which cooling water is delivered when the reheat furnace is at operating temperatures.

Figure 6:
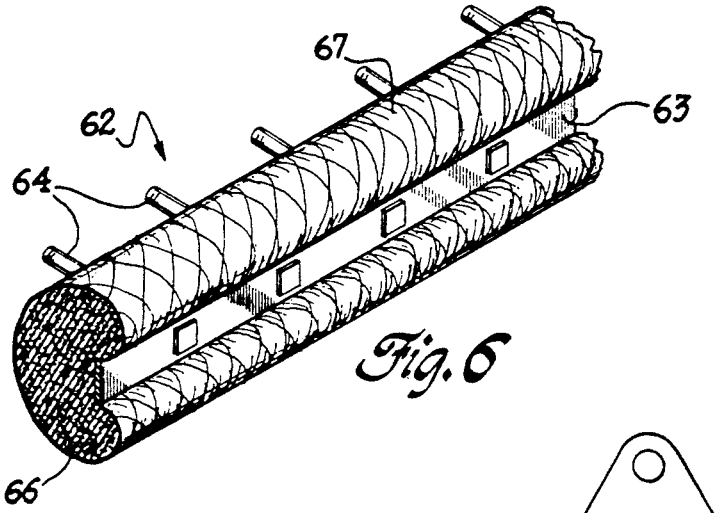
FIG. 6 is a perspective illustration of a thermal insulation strip seen in section in FIG. 5.

Reverting to FIGS. 4 and 5, a steel mesh curtain support assembly 50 is suspended from pivot blocks 51 which are secured to the outside of the furnace end wall 15, above and spaced from the discharge opening 17. The curtain supporting assembly 50 is urged into contact with the furnace lintel 40 by means of a counterweight 52 secured to the distal end of a shaped steel bar 53 which is pivotally secured to the pivot block 51. In one embodiment, FIG. 7, the curtain supporting assembly 50 includes a generally horizontal beam 54 and a pair of generally rectangular steel tubes 55, 56 which are spaced-apart and secured along their top edge to the bottom flange 57 of the beam 54. Unobstructed pipes 58, 59 are secured through the vertical walls of the conduits 55, 56 at spaced locations. Water passageways 60, 61 are presented along the conduits 55, 56 respectively. A strip of thermal insulation 62 as shown in FIG. 6, is secured to the curtain supporting structure 50 by means of a metal alloy strip 63 and a metal alloy rod 64 which extends through the tubes 55, 56 respectively and is secured by an appropriate means such as a threaded nut 65. The thermal insulation strip 62, as seen in FIG. 6, includes randomly oriented refractory fibrous material 66 which is wrapped with a thin cylindrical fibrous mesh 67 and is obtained as a cylindrical strip. The steel bar 63, when compressed against the insulation 62, deforms the circular cross-section to a bean shape as illustrated in FIGS. 6, 7.

Figure 12:
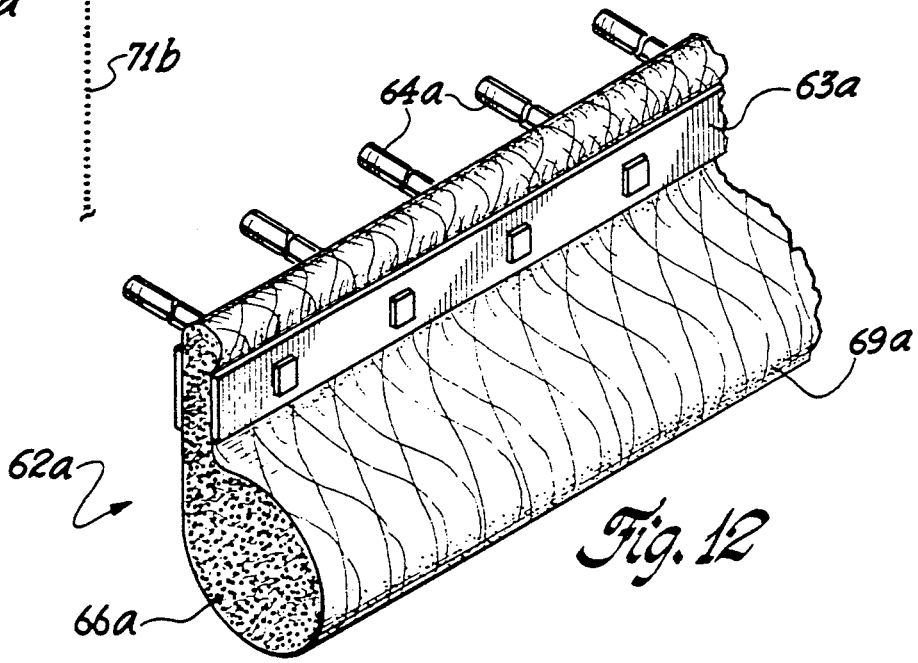
FIG. 12 is a perspective illustration of an alternative embodiment of a thermal insulation strip.

An alternative to the bean-shaped thermal insulation strip 62 is illustrated in FIG. 12 as a "tadpole" shape strip 69*a* formed from a cylindrical strip of refractory fibers 66*a* deformed by a metal alloy rod 63*a* secured through the insulation strip 62*a* by means of bolts 64*a*.

Figure 7:
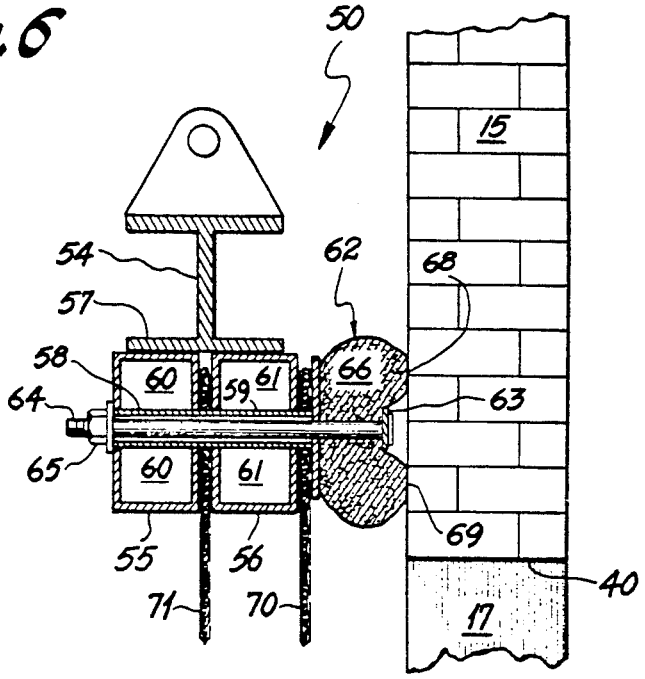
FIG. 7 is a fragmentary sectional illustration, similar to FIG. 5, showing a preferred embodiment of a support for a metal alloy wire mesh curtain.

It will be observed from FIG. 7 that the insulation strip 62 abuts the water-cooled lintel 40 along two edges 68, 69. As a result of the mounting, the thermal insulation 62 or 69*a* prevents stingers from appearing at the top of the discharge opening 17. Stingers are known in the reheat furnace art to be finger-like flames of burning gas and incandescent air-borne particles.

It will be observed from FIG. 7 that curtains 70, 71 are secured to and depend from the supporting structure 50. The interior curtain 70 is retained at its upper end between the water-cooled conduit 56 and the thermal insulation strip 62. The exterior curtain 71 is retained at its upper end between the two water cooled tubes 55, 56. The exterior woven mesh curtain 71 is formed from relatively coarse woven ribbons and the interior woven mesh curtain 70 is formed from less coarse metal alloy woven mesh. Accordingly the interior curtain 70 is less permeable that the exterior curtain 71.

Figure 9:
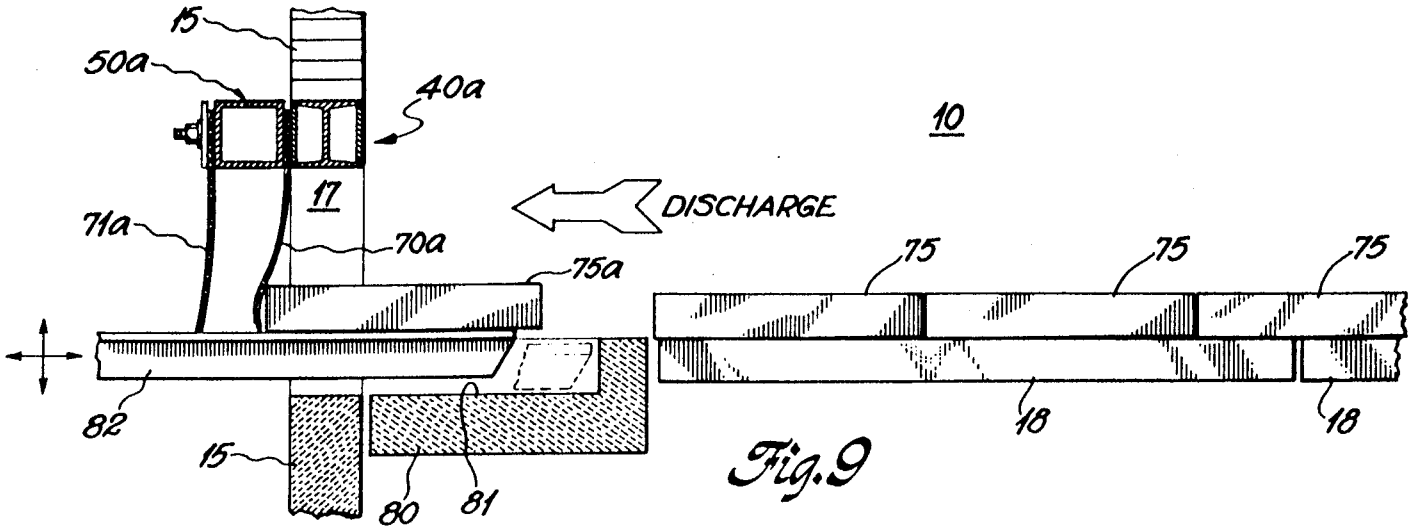
FIGS. 9 and 10 are side elevation sketches of a high temperature reheat furnace discharge opening having metal alloy wire mesh curtains engaging steel workpieces being discharged from the discharge opening.
Figure 10:
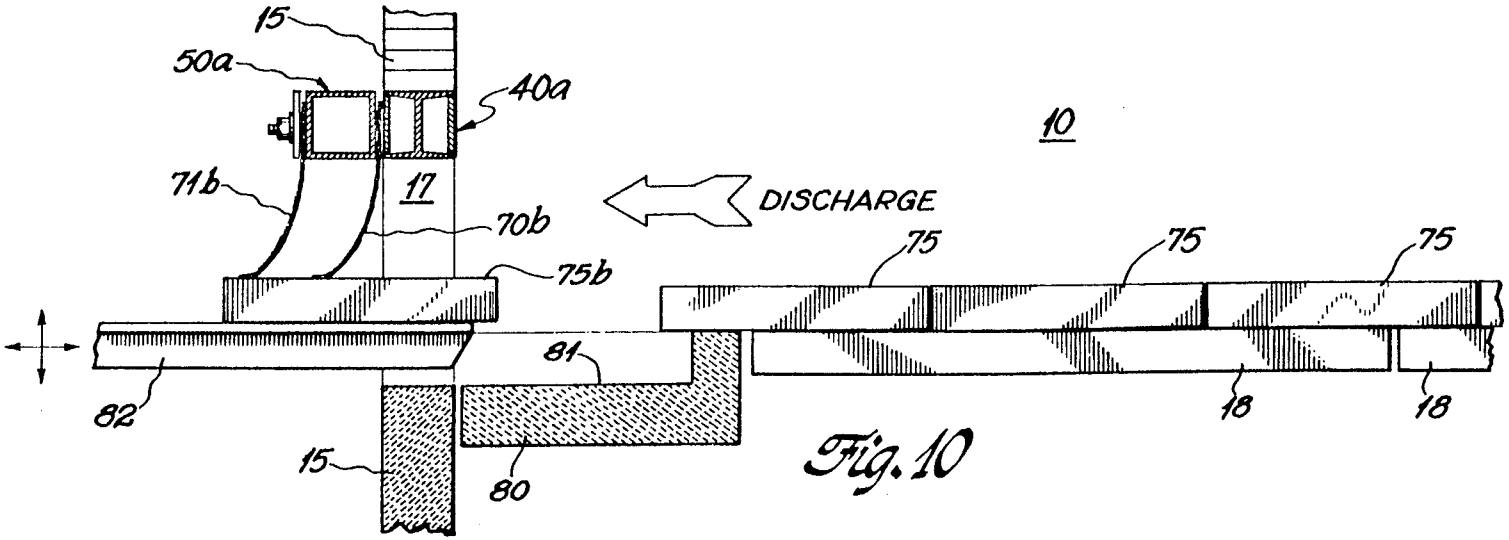
Figure 11:
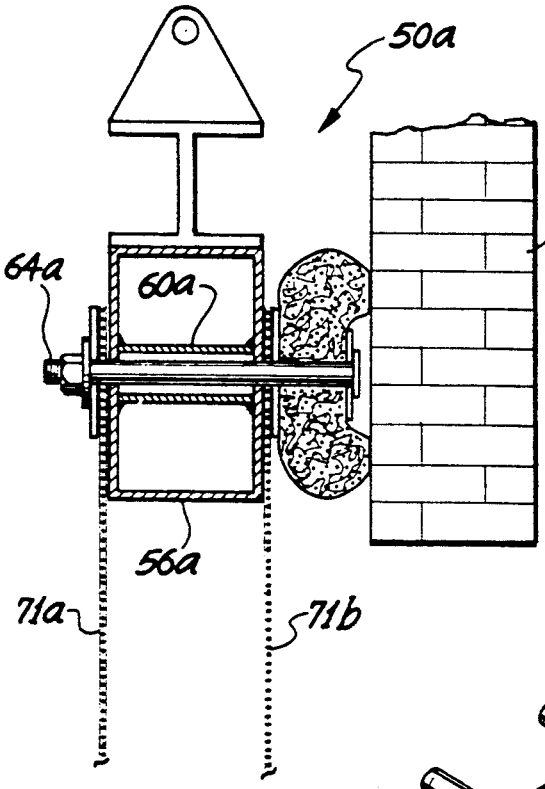
FIG. 11 is a fragmentary sectional illustration similar to FIG. 7 showing an alternative embodiment of the curtain support.

FIGS. 9 and 10 illustrate steel workpieces 75 supported on horizontal rail 18. A forward steel workpiece 75*a* has entered the discharge opening 17 and has engaged the interior curtain 70*a*. It will be observed that the forward pieces 75*a* are supported above the refractory hearth 81 by lifters 82 which elevate and withdraw the workpiece 75*a*. The lifter 82 is shown partially withdrawn from the slot 80.

The exiting workpiece 75*a* advances the interior curtain 70*a* which begins to drape over the exiting workpiece 75*a*. The exiting workpiece is identified as 75*b* in FIG. 10 where a substantial portion of the exiting workpiece 75*b* has advanced through the discharge opening 17 and engages both steel curtains 70*b* and 71*b* which are flexible in the direction of movement and readily drape over the exiting workpiece 75*b*.

It will be observed from FIGS. 9 and 10 that the workpieces 75 are in end-to-end contact in the manner of a pusher furnace when supported on the horizontal beam 18. It should be apparent that the steel workpieces 75 may be spaced-apart as they would be presented in a walking-beam furnace.

EXTRACTOR SLOT ACCOMMODATION

In those reheat furnaces having slots for receiving lifters, additional means may be provided for retaining furnace heat which might otherwise escape through the slots when the lifters are inactive.

In one embodiment the curtains of FIGS. 4, 5 are comprised of wide ribbons 70, 71 and narrow ribbons 83 having extensions 83*a* which cover the slot 81. Some means must be provided to elevate the narrow ribbon extension 83*a* prior to entry of a lifter 82 into the slot 81. One means is a chain 84 adapted to elevate the narrow ribbon extensions 83*a* (not seen in FIG. 4) and 86*a* as particularly shown by the chain 84*a* on the right hand slot of FIG. 4. As more clearly seen in FIG. 5, the chain 84 is connected to an appropriate connector 85 which is secured to the narrow ribbon extension 83*a* of the outer ribbon 83. A corresponding inner ribbon 86 has a narrow ribbon extension 86*a* which is joined to the narrow ribbon extension 83*a* by an appropriate connector 87. Thus when the chain 84 is pulled upwardly, the narrow ribbon extensions 83*a*, 86*a* will rise above the top level of the slot 80 and permit the lifter 82 to enter into the slot 80 without interfering with the curtains. It should be observed that the remainder of each curtain 83, 86 remains in a heat shielding position (FIG. 5) while the lifter 82 is in the slot 80.

Figure 13:
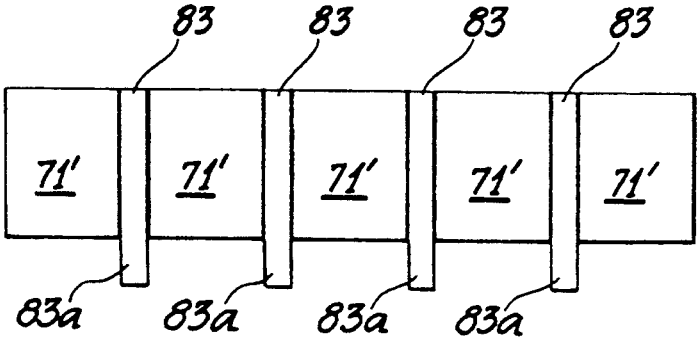
FIG. 13 is a schematic illustration of a preferred curtain arrangement which includes wide and narrow ribbons of metal alloy mesh to accommodate slot openings beneath a discharge opening.

In FIG. 13, an embodiment of the invention is illustrated wherein the external curtain 71 comprises multiple wide ribbons 71' and multiple narrow ribbons 83. The narrow ribbons have a narrow ribbon extension 83*a* which corresponds in profile with the oven slots (not see in FIG. 13).

Figure 14:
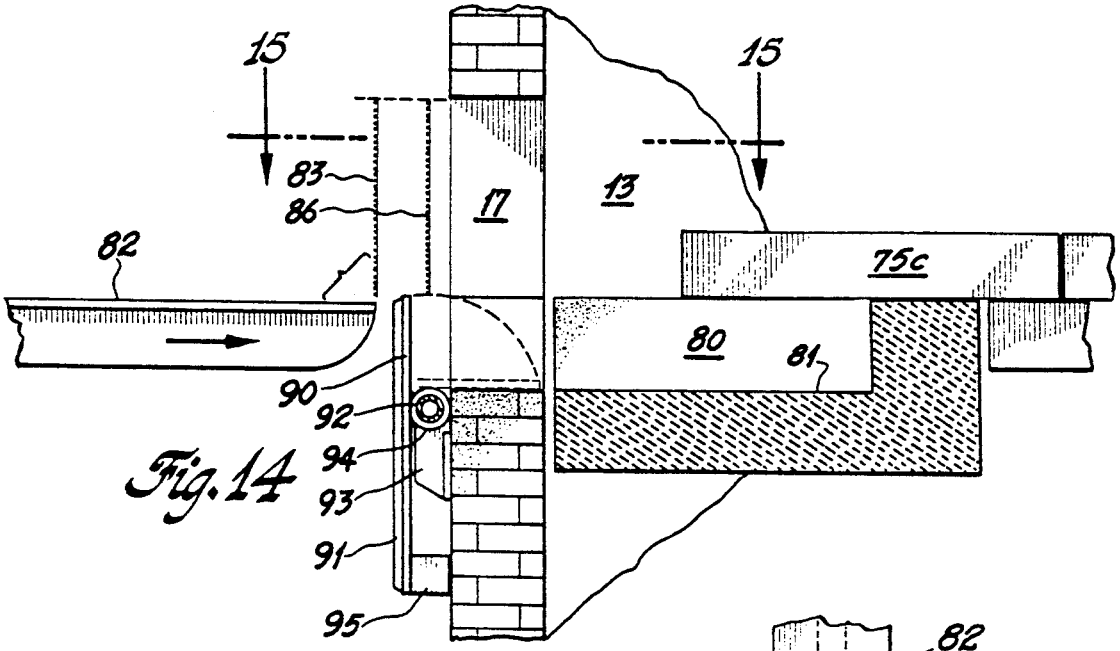
Figure 15:
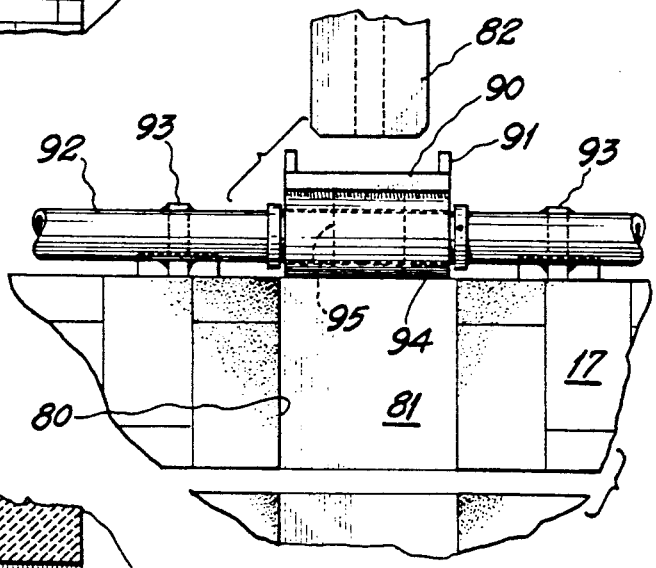
FIG. 15 is a plan view taken along the line 15—15 of FIG. 14 showing a water-cooled pivot support for the embodiment of FIGS. 15, 16, 17.
Figure 16:
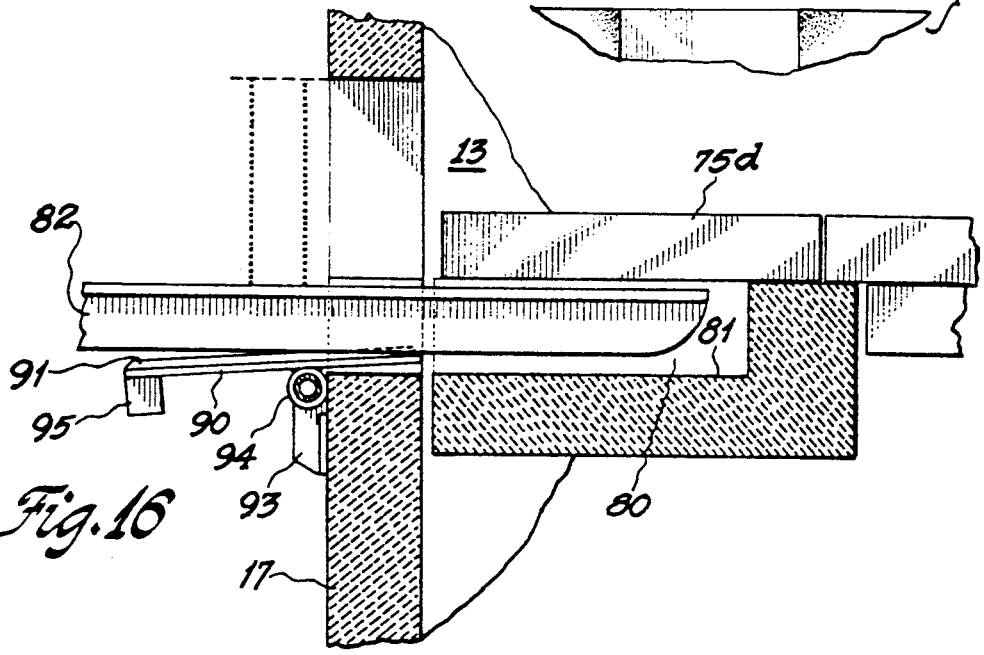

An alternative embodiment for retarding loss of heat from the furnace through the slots is illustrated in FIGS. 14, 15, 16, 17 where a generally flat sheet 90 constitutes a heat shield which covers the furnace slot 80 when the lifter 82 is inactive. The curtains 83, 86 terminate above the top of the lifters 82. FIG. 14 illustrates the normal orientation of the components with the lifter 82 in an inactive position. The sheet 90, preferably a flat sheet, may be equipped with appropriate reinforcing strips 91 for rigidity and is preferably secured in a pivotal manner below and outside the discharge opening 17. A water carrying pipe 92 is secured to the furnace wall by means of brackets 93. The sheet 90 is rotatably secured to the pipe 92 by brackets 94. An appropriate counterweight 95 normally maintains the sheet 90 in a generally vertical, slot shielding position as shown in FIG. 14. The leading workpiece is indicated as 75*c* in FIG. 14; as 75*d* in FIG. 16; and as 75*e* in FIG. 17.

When the lifter 82 enters the slot 80, the sheet 90 is pivoted by contact with the under surface of the lifter 82 with the upper edge of the sheet 90 and thereby the slot 80 is unobstructed to the entry of the lifter 82. When the lifter 82 is extracted together with a forward workpiece 75*e*, the heat shielding sheet 90 commences to return to its normal, generally vertical position as shown in FIG. 17 through the gravity effect of the counterweight 95. After the lifter 82 has completely withdrawn from the discharge opening 17, the heat shielding sheet 90 is automatically restored to its heat shielding disposition of FIG. 14.

Figure 1:
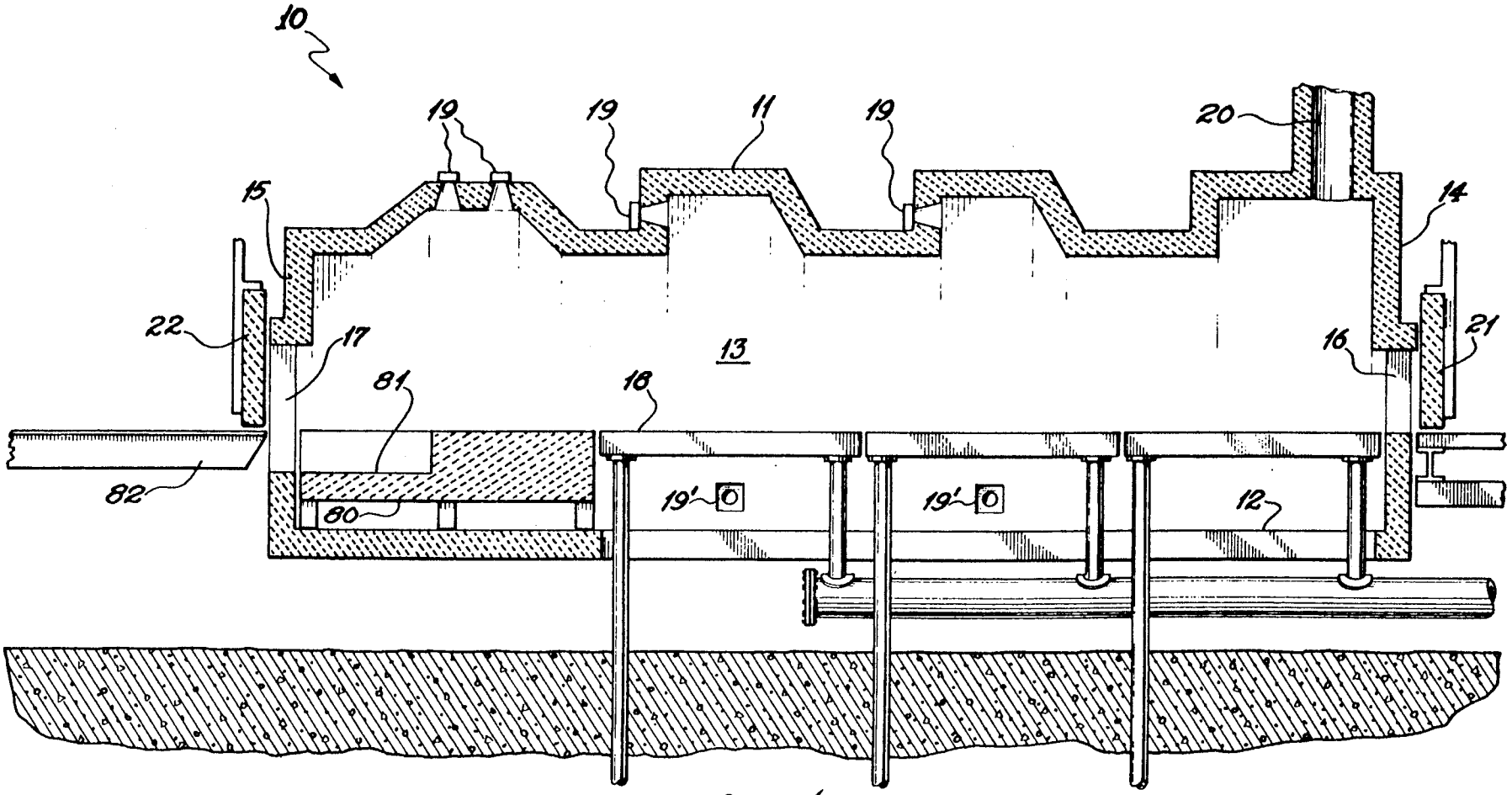
FIG. 1 is a schematic side elevation view of a typical steel reheat furnace.

Referring to FIG. 18, there is illustrated a charging opening of a reheat furnace similar to that illustrated in FIG. 1 where corresponding numerals indicate corresponding elements.

The furnace chamber 13 is enclosed, in part, by a floor 12 and vertical wall 14. A charging opening 16 is provided in the vertical wall 14. Within the furnace chamber 13, steel workpieces 75*f* are supported on generally horizontal rails 18. A supporting table 96 provides generally horizontal support for incoming steel workpieces 75*g*. It will be observed that the incoming steel workpiece 75*g* has its leading edge in contact with the trailing edge of the steel workpiece 75*f* which has already entered into the oven chamber 13. Pusher means (not shown) are provided to advance the steel workpieces 75*g*, 75*f* and the other steel workpieces which are in the pusher advancement mode.

A curtain supporting structure 97 includes a mounting block 98 secured to the outer surface of the vertical wall 14 above the charging opening 16. A crank arm 99 is pivotally connected to the mounting block 98 at one end and pivotally connected at the other end to a water cooled curtain holder 100 which includes a tubular member 101 adapted to receive cooling water through a water receiving conduit 102 and to discharge heated cooling water by means (not shown). The curtain holder 101 has secured to one surface a fibrous thermal insulation batt 103, similar to the batt 62 of FIG. 6. The batt 103 engages the outer surface of the vertical wall 14 to retain heat within the chamber 13 and to preclude "stingers" which are blowing gas-borne particles. The vertical wall 14 also may include a water cooled lintel 104 similar to the lintel 40*a* described in connection with FIG. 8.

The curtain holder 101 supports two alloy mesh curtains 105, 106 which correspond respectively with the curtain 70, 71 previously described. That is, the curtain 105, adjacent to the furnace wall 14, has a finer mesh and is less gas pervious than the other curtain 106 which is remote from the vertical wall 14.

As the steel workpieces 75*f* and 75*g* advance into and through the furnace chamber 13, the curtains 106, 105 drape over the top surfaces of the steel workpieces 75*f*, 75*g* and serve to retain heat within the chamber 13. The curtains 105, 106 in their normal depending position, i.e., when there are no workpieces in the opening 16, will hang to a level near the bottom wall of the opening 16.

While similar structural devices have been employed heretofore to retain heat at the discharge openings 16 of reheat furnaces, the composition has not heretofore been critical because prior reheat furnaces had a relatively low temperature in the chamber 13 adjacent to the charging opening 16. With the advent of radiant heaters, substantial elevated temperatures may exist within a reheat furnace, even adjacent to the charging opening 16. The metal alloy mesh proposed in this invention will permit the use of prior art curtain structures for the charging openings of such reheat furnaces. The alloy is described as a high temperature, sag-resistant metal alloy wire, formed from chromium/iron-/aluminum alloys, e.g., Kanthal APM, the trademark of a chromium/iron/aluminum alloy of Kanthal, AB.

I claim:

1. A closure for a charging opening of a reheat furnace having heating means which develop high temperatures, above 2000° F., in the region of said charging opening, said closure comprising:

a water-cooled curtain holder secured outside said furnace at the upper edge of said charging opening; a water passageway extending lengthwise through said curtain holder; plural, parallel ribbons of woven, high-temperature, sag-resistant alloy metal wire, each said ribbon being secured at its top end in heat-conductive relation with said curtain holder and depending vertically toward the bottom of said discharge opening; said parallel ribbons substantially entirely covering said charging opening when depending freely from said curtain holder and being adapted to for lateral displacement to accommodate entry of a workpiece through said charging opening.

2. A discharge closure for a reheat furnace having a discharge opening for removing heated workpieces, comprising:

a water-cooled curtain holder secured outside said furnace at the upper edge of said discharge opening; a water passageway extending lengthwise through said curtain holder; plural, parallel ribbons of woven, high-temperature, sag-resistant alloy metal wire, each said ribbon being secured at its top end in heat-conductive relation with said curtain holder and depending vertically toward the bottom of said discharge opening; said parallel ribbons substantially entirely covering said discharge opening when depending freely from said curtain holder and being adapted to for lateral displacement to accommodate withdrawal of a workpiece through said discharge opening.

3. The discharge closure of claim 2 wherein the said sag-resistant alloy metal wire is a chromium/aluminum-/iron alloy.

4. The discharge closure of claim 2 wherein said ribbons engage the bottom of said discharge opening.

5. The discharge closure of claim 2 wherein said ribbons are suspended in a common vertical plane.

6. The discharge closure of claim 2 including a horizontal strip of fibrous thermal insulation, secured to said curtain holder and engaged with said furnace above said discharge opening.

7. The discharge closure of claim 2 including means for urging said strip of fibrous thermal insulation against the outer wall of said furnace.

8. The discharge closure of claim 2 wherein said reheat furnace includes lifters for removing heated workpieces through said discharge opening, and including lifter-receiving recesses beneath said discharge opening, the further improvement comprising means for reflecting radiant heat from said recesses when said lifters are outside said recesses.

9. The discharge closure of claim 8 wherein said means for reflecting radiant heat comprises extensions of said ribbons below said discharge opening in the region of said recesses and means for withdrawing said extensions when said lifters are in said recesses.

10. The charging opening closure of claim 2 wherein the said sag-resistant alloy metal wire is a chromium-/aluminum/iron alloy.

11. A discharge closure for a reheat furnace having a discharge opening for removing heated workpieces, comprising:

a water-cooled curtain holder secured to said furnace at the upper edge of said discharge opening; at least one water passageway extending lengthwise through said curtain holder; a first curtain and a second curtain, each comprising plural, parallel ribbons of woven, high-temperature, sag-resistant alloy metal wire, each said ribbon being secured at its top end in heat-conductive relation with said curtain holder and depending vertically toward the bottom of said discharge opening; said parallel ribbons substantially entirely covering said discharge opening when depending freely from said curtain holder and being adapted for lateral displacement to accommodate withdrawal of a workpiece through said discharge opening, said first curtain being generally parallel to and horizontally spaced-apart from said second curtain.

12. The discharge closure of claim 11 wherein said first curtain is interposed between said second curtain and said furnace, and said second curtain has less gas permeability than said first curtain.

13. The discharge closure of claim 1 wherein the ribbons of said first curtain contain thicker wire than the ribbons of said second curtain.

14. The discharge closure of claim 11 wherein the ribbons of said first curtain are suspended in a first common vertical plane and the ribbons of said second curtain are suspended in a second common vertical plane which is horizontally spaced-apart from said first common vertical plane.

* * * * *